US006066407A

United States Patent [19]

Getz

[11] Patent Number: 6,066,407

[45] Date of Patent: May 23, 2000

[54] WEAR RESISTANT PARTS FOR HAMMERS AND CHIPPERS

[76] Inventor: Roland A. Getz, P.O. Box 6249, Phoenix, Ariz. 85005

[21] Appl. No.: 09/094,608

[22] Filed: Jun. 15, 1998

[51] Int. Cl.[7] ..... B32B 15/00

[52] U.S. Cl. ..... 428/683; 428/615; 164/98; 241/291; 76/103

[58] Field of Search ..... 76/103; 241/291; 428/683; 164/98

[56] References Cited

U.S. PATENT DOCUMENTS 3,404,847 10/1968 Smith ..... 241/291
3,640,324 2/1972 Porter ..... 81/20
3,712,284 1/1973 Porter ..... 125/40
4,770,253 9/1988 Hallisay et al. .
4,903,609 2/1990 Isakov et al. .
5,337,801 8/1994 Materkowski .

*Primary Examiner*—Deborah Jones
*Assistant Examiner*—Jason Resnick
*Attorney, Agent, or Firm*—James Creighton Wray; Meera P. Narasimhan

[57] ABSTRACT

Long life wear parts are cast with mounting structures at proximal ends and relatively thin carbide layers at distal ends. The distal end carbide layers are filled with cast carbide material and distal faces of the cast steel wear parts are covered with the thin carbide layer. Hardness of the wear parts increases toward the distal end. The proximal end is left unhardened to provide strength and resist breaking, and resist wearing of the base and fasteners which mount the wear parts. In one form portions of distal ends of molds are lined with sintered tungsten-carbide steel wear surfaces before parts are cast.

18 Claims, 22 Drawing Sheets

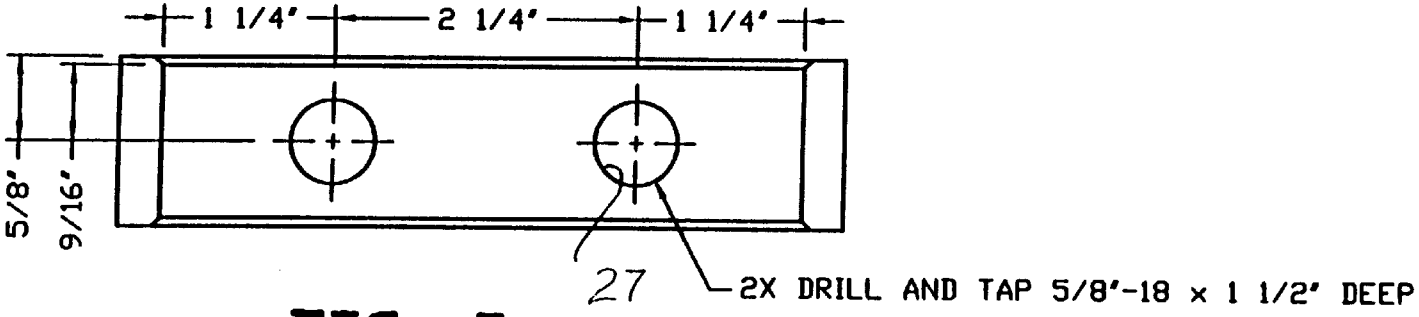
FIG. 7
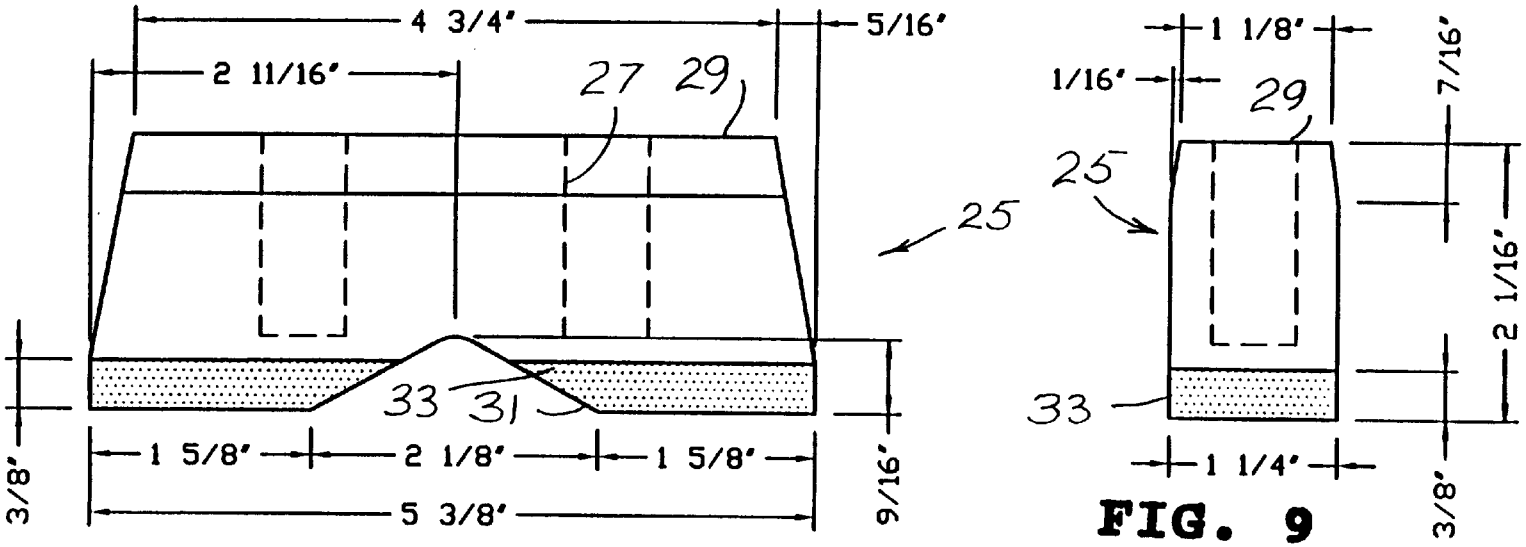
FIG. 8
FIG. 9

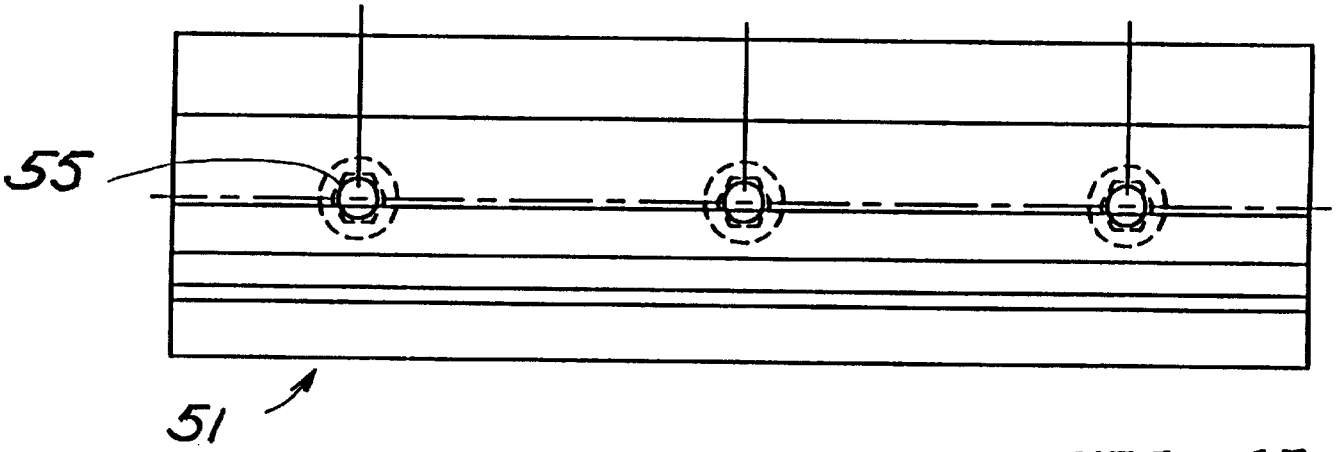
FIG. 17
FIG. 16
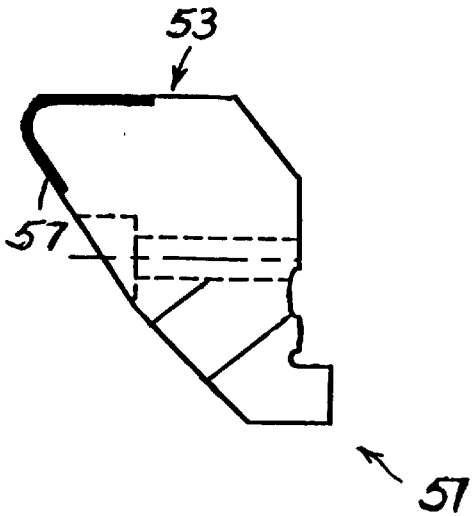

WEAR RESISTANT PARTS FOR HAMMERS AND CHIPPERS

BACKGROUND OF THE INVENTION

Products such as hammers or chippers used to reduce sizes of materials are subject to continued wear. Replacing of the parts is expensive from the standpoint of buying new parts, but is even more expensive from the labor required to replace the parts. Some of the parts are extremely heavy and require lifting equipment to remove old parts and insert new parts. However, the greatest cost in replacing of wear parts is the down time of equipment.

The loss of productive time to the equipment may far exceed the cost of the wear parts and the cost of the labor and auxiliary equipment which is necessary to remove the old wear parts and to replace them with new wear parts.

Added cost of replacement wear parts exists in the shipping of the parts and the inventorying of the parts. High inventories are necessary to restrict the down time to minimal times.

Once parts are worn they are useless and have value only as scrap. The differential between the cost of new wear parts and the scrap value of old wear parts is extreme.

Examples of wear parts which need to be replaced are found in hammer mills, waste recyclers and chippers. Another example is found in teeth of digging equipment. Any advance which can increase the life of wear parts reduces enormous losses and cost of replacement parts, cost of the replacement process, and loss of productive use of the equipment during the replacement, in addition to inventorying and shipping costs.

SUMMARY OF THE INVENTION

The present invention overcomes and avoids problems of the prior art.

In a preferred casting process, distal ends of molds are lines with broken pieces and particles of hard abrasive material such as tungsten-carbide. Steel is cast in the mold and flows into spaces between and around the pieces and particles, trapping them in a steel matrix.

In an alternative process, long life wear parts are cast with mounting structures at proximal ends and relatively thin recesses at distal ends. The distal end recesses are filled with cast carbide material and distal faces of the cast steel wear parts are covered with the thin carbide-embedded steel layer. Hardness of the wear parts increases toward the distal end. The proximal end made of mild steel is left unhardened to provide strength, to resist breaking, and to resist wearing of the base and fasteners which mount the wear parts.

Preferred wear resistant wear parts have a cast mild steel body with proximal and distal ends, an attachment mount at the proximal end of the body, and a surface recess surrounding the distal end of the body. The surface recess is filled with carbide-embedded steel so that an entire carbide layer coats the distal impact end of the body.

Wear resistant wear parts preferably have a cast carbon steel body with proximal and distal ends, an attachment mount at the proximal end of the body, and a surface recess in the distal end of the body. The surface recess is filled with carbide so that an entire carbide layer coats the distal end of the body.

In one form the body is heat treated and hardened near the distal end.

Preferably the wear part body has milder steel in the proximal end.

In one form hardness increases from the proximal end to the distal end. Preferably the body is cast.

In one embodiment a recess extends around lateral surfaces of the wear parts adjacent the distal end, and the carbide layer coats the wear parts in the recess and over the distal end so that sides of the body near the distal end are commensurate with sides of the body near the proximal end.

In one embodiment sides of a carbide layer taper outwardly from the distal end toward the proximal end, and the carbide layer is thinner near the proximal end. Ends of the recess closest the proximate end are sloped.

Preferably the coating layer is about ⅜" thick.

In some embodiments the carbide layer extends laterally outward from the recesses. In some cases opposite leading and trailing end faces are covered with the carbide-containing layer and the opposite side faces are bare. Preferably the opposite leading and trailing edge faces have the carbide layers near the proximal end.

In one embodiment lateral distal faces of the wear parts have major recesses around which steel of increased carbon content is cast. Carbide inclusions in the increased carbon steel layers are formed near the distal ends. The carbide layer fills the distal ends in the second molded steel layer.

In some embodiments the distal ends have extended shapes with respect to the proximal ends. In other embodiments the proximal ends have extended shapes with respect to the distal ends.

Casting the wear parts with mounting configurations at proximal ends and molding recesses at distal ends, and filling the recesses with carbide material makes some of the embodiments.

Molding mild steel, forming a first recess at a distal end of the mild steel, molding a carbon steel in the recess at the distal end of the mild steel, and molding a relatively thin carbide-containing layer in a distal end of the carbon steel and filling the thin carbide steel layer is one embodiment of the method. Preferably hardness of the steel increases from the proximal to the distal end.

These and further and other objects and features of the invention are apparent in the disclosure, which includes the above and ongoing written specification, with the claims and the drawings.

BRIEF DESCRIPTION OF THE DRAWINGS

FIGS. 7, 8 and 9 are top, side and end views of an alternate hammer.

FIGS. 16 and 17 are end and top views of a high solid hammer.

DETAILED DESCRIPTION OF THE PREFERRED EMBODIMENTS

Figure 2:
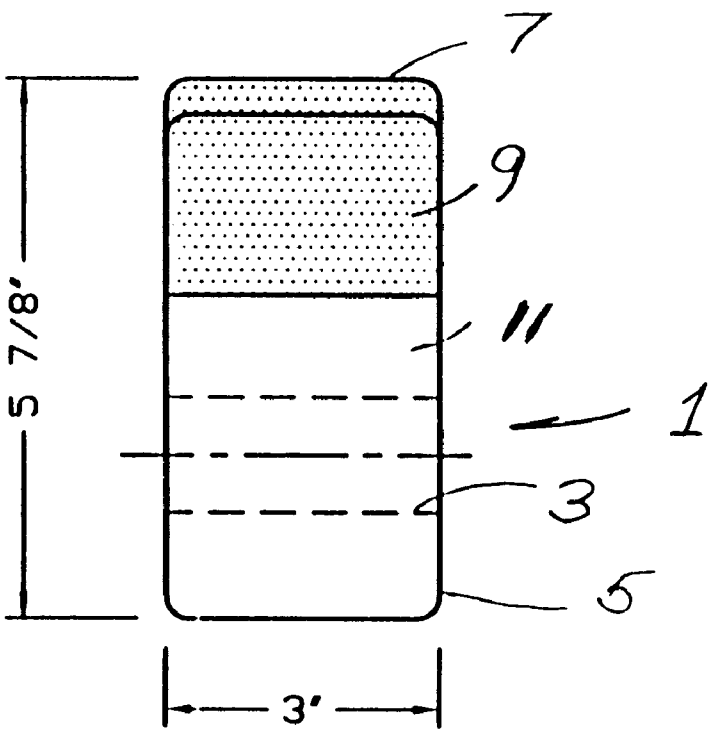
FIGS. 1 and 2 are side and end elevations of carbide coated hammers of the present invention.
Figure 1:
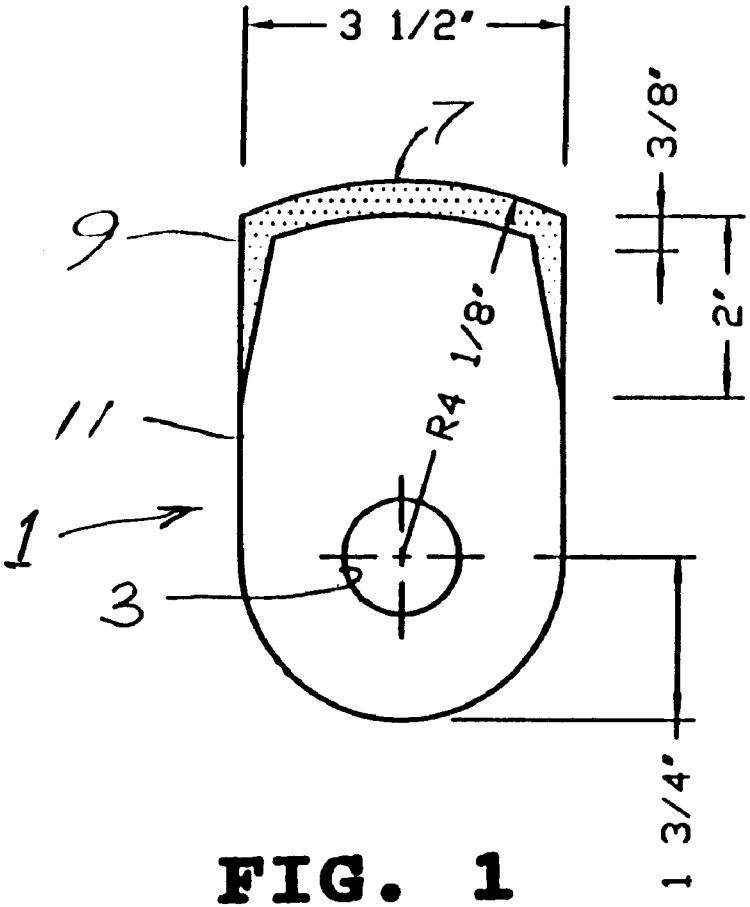

Referring to the drawings, FIGS. 1 and 2 show side and end views of a hammer 1. The hammer has a mounting hole 3 at a proximal end 5, and a carbide layer 7 approximately ⅜" thick at a distal end 9. The carbide layer extends 11 on the end walls with a tapered 13 thinning of the end wall layer 11.

The hammer shown in FIGS. 1 and 2, as all hammers, is preferably made by combining tungsten-carbide powders and heating them under pressure at sintering temperatures. The resultant product is broken into particles which are placed in a mold. The molds are filled with steel and the particles are embedded in the steel near the surface of the molds. The mold may be filled with mild steel, which does not break. Alternatively, the mold may be partially filled with carbon steel and then filled with mild steel to form the attachment proximal end.

As shown in FIG. 1, a straight top hammer 1 has an attachment opening 3 near a proximal end 5. A distal end 7 has a layer, approximately ⅜" thick, of tungsten-carbide particle filled-steel 9. The layer extends over the sides 11 of the layer 9 tapered outwardly, as shown in FIG. 1, near the middle of the tool. The proximal end 5 of the hammer may be made of mild steel. The distal end 7 is made of high carbon steel. The layer 9 is made of tungsten-carbide particles in a steel matrix.

Figure 4:
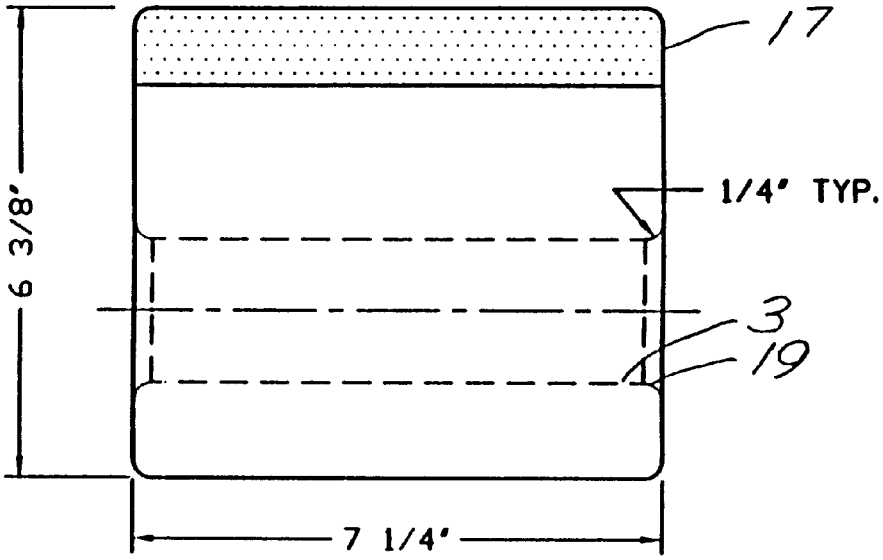
FIGS. 3 and 4 are side and end elevations of hammers.
Figure 3:
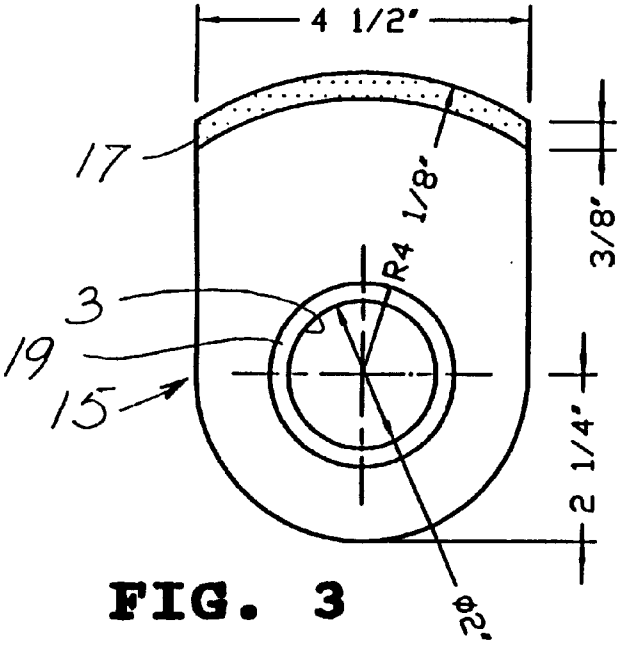

A wide straight top hammer generally indicated by the numeral 15 is shown in FIGS. 3 and 4. The hammer 15 has a layer 17 approximately ⅜" thick of tungsten-carbide particles embedded in the steel of the hammer. The mounting opening 3 is countersunk 19 to aid in insulation of the hammer.

Figure 6:
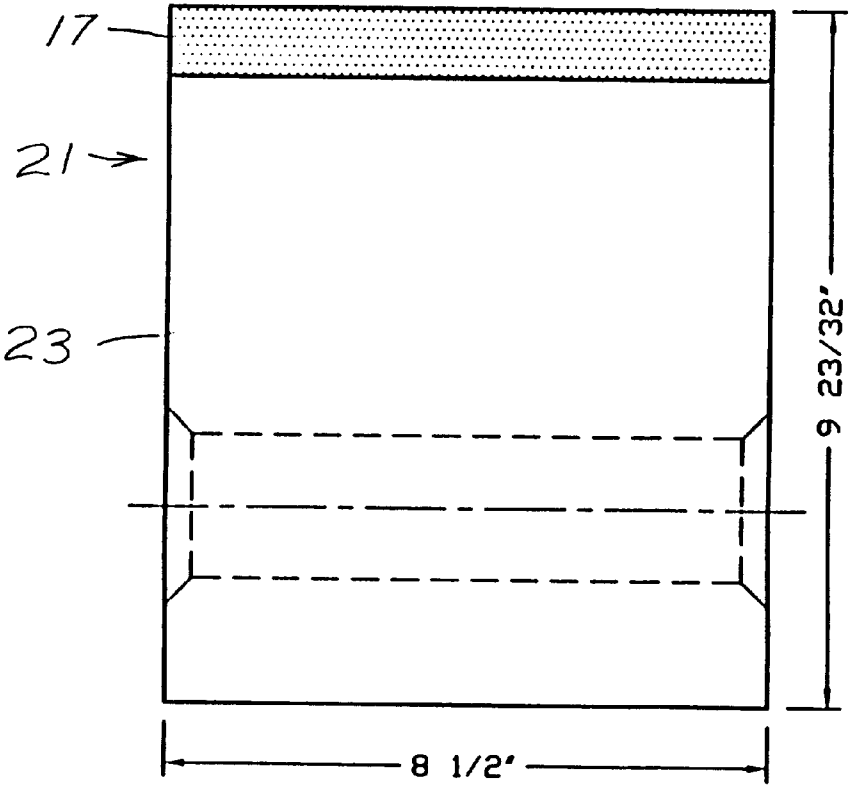
FIGS. 5 and 6 are side and end elevations of swing hammers constructed according to the present invention.
Figure 5:
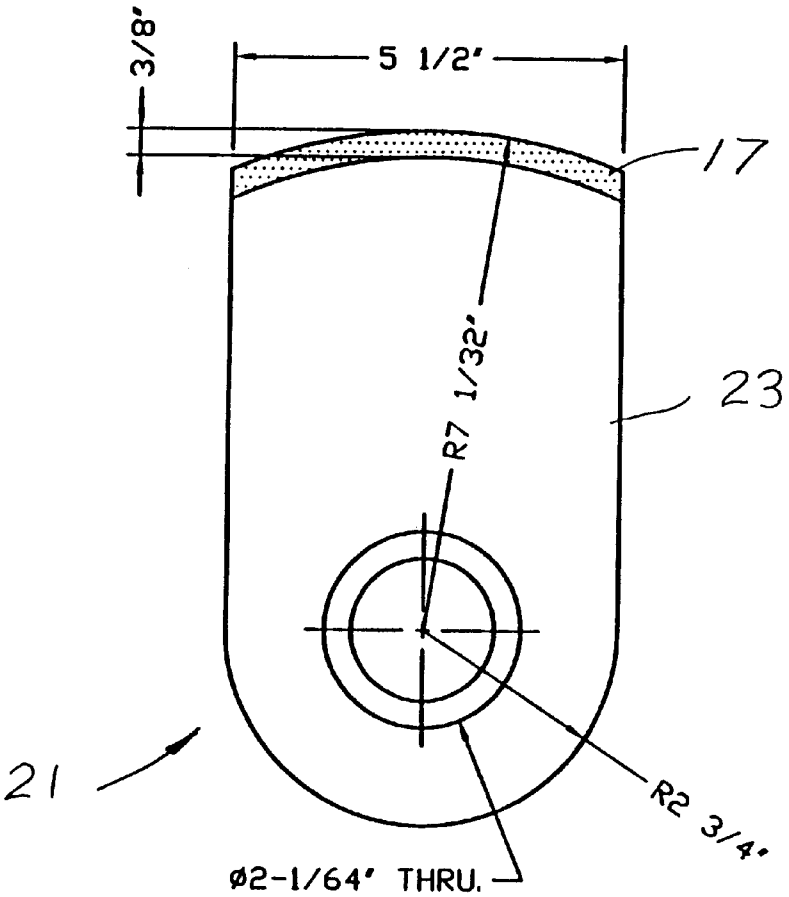

A similar swing hammer 21 is shown in FIGS. 5 and 6. The swing hammer 21 has a similar uniform tungsten-carbide-embedded steel layer 17 on its outer active surface. A central portion 23 of the swing hammer is elongated.

Referring to FIGS. 7, 8 and 9, the hammer 25 has two threaded mounting holes 27 at its proximal end 29. Distal end 31 has two separate ⅜" layers of tungsten-carbide-embedded steel 33.

Figure 12:
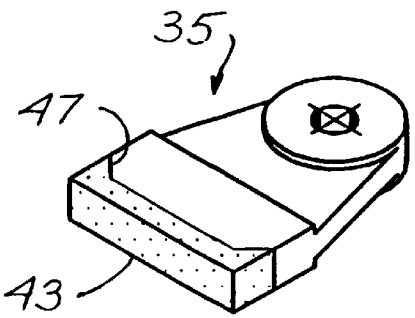
FIGS. 10, 11 and 12 are side, end and perspective views of a swing shredder blade.
Figure 11:
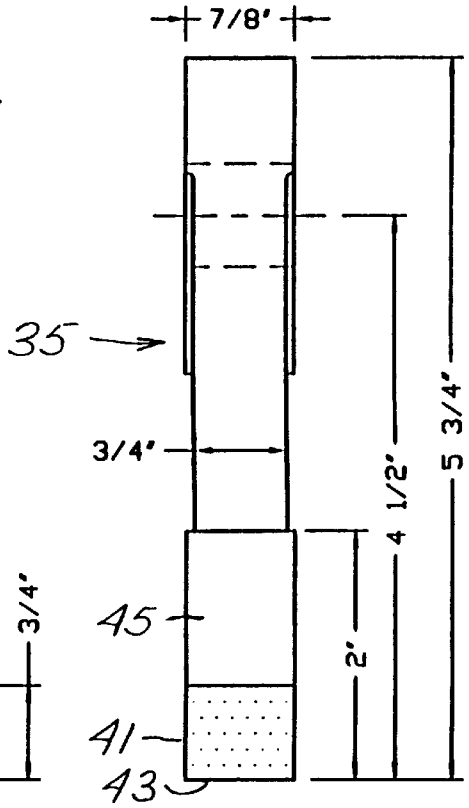
Figure 10:
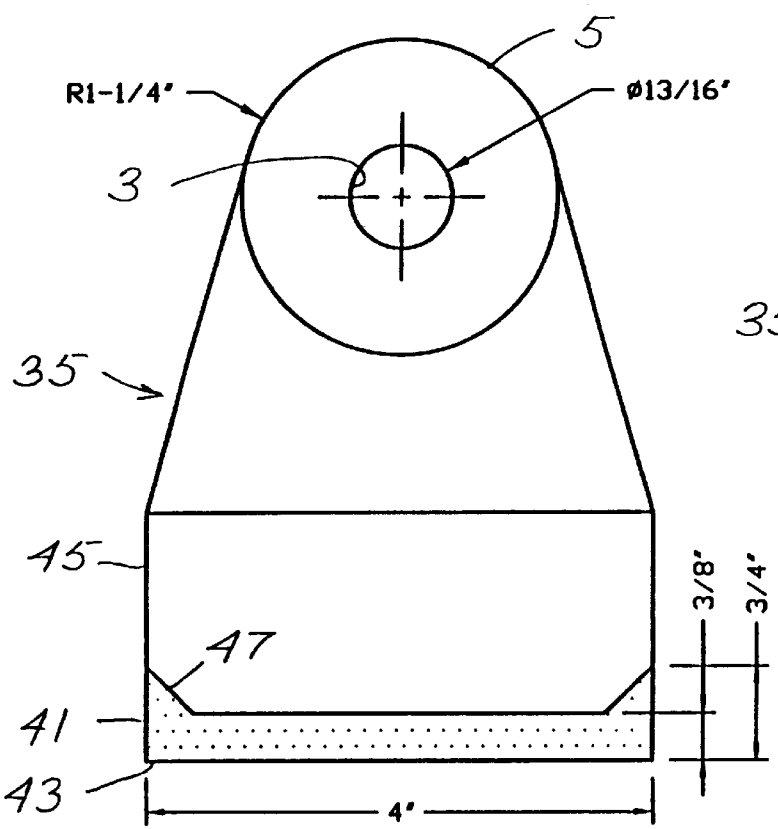

In FIGS. 10, 11 and 12, a narrow shredder blade 35 is shown. Shredder blade 35 has an enlarged cylindrical mounting section 37 at its proximal end 39. A mounting hole 3 extends through the proximal end. The entire shredder blade 35 is made of steel. A ⅜" thick carbide layer 41 covers the distal end 43. The carbide layer is continued along the sides 45 and is tapered 47 to enlarge the side edges where maximum contact may occur in shredded blades.

Figure 15:
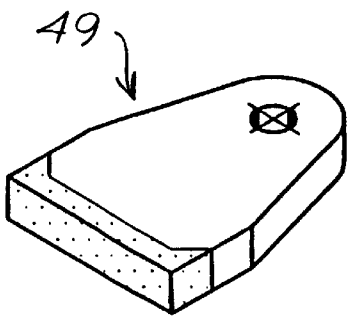
FIGS. 13, 14 and 15 are side, end and perspective views of an alternate shredder blade constructed according to the invention.
Figure 14:
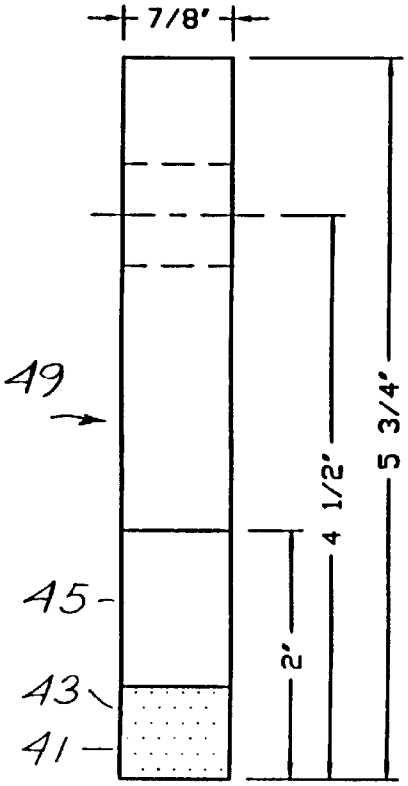
Figure 13:
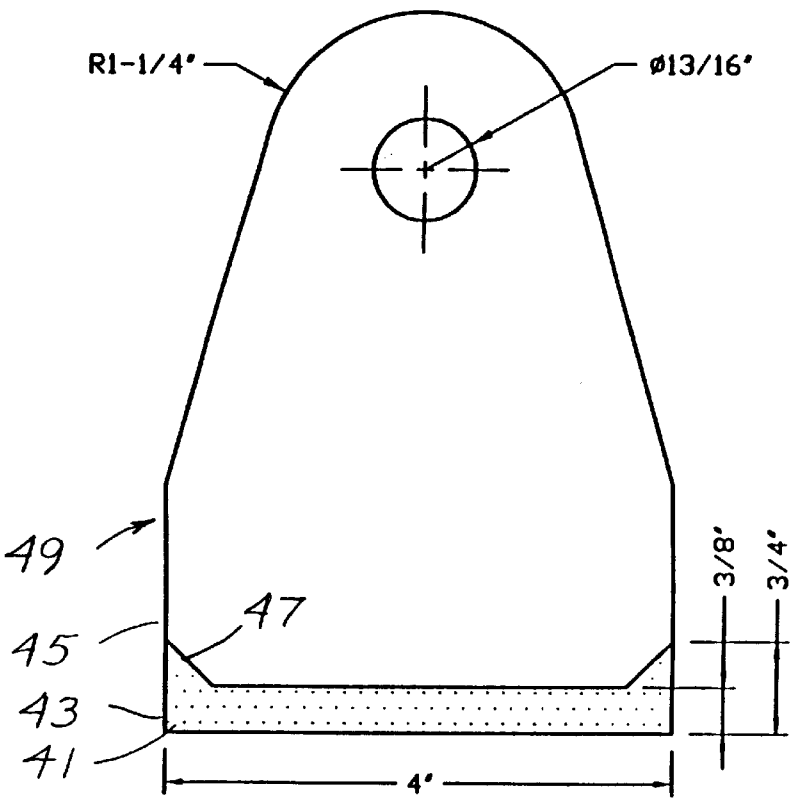

FIGS. 13, 14 and 15 show a similar, but flat, shredder blade 49.

FIGS. 16 and 17 show a high solid hammer 51 with a carbide tip 53. The hammer 51 has three mounting holes 55 in the center and has a thin carbide tip on its curved edge 57.

Figure 19:
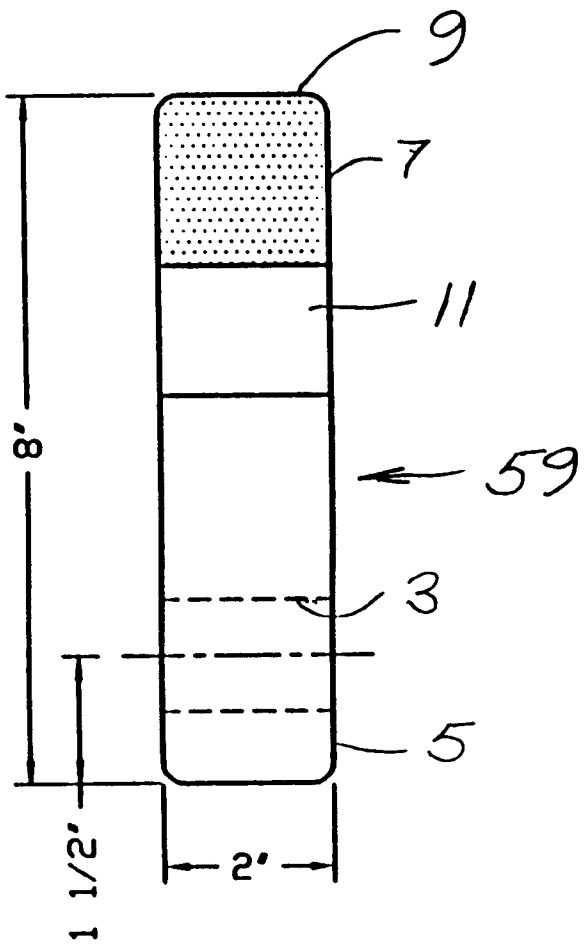
FIGS. 18 and 19 are side and end views of a coal crusher constructed according to the invention.
Figure 18:
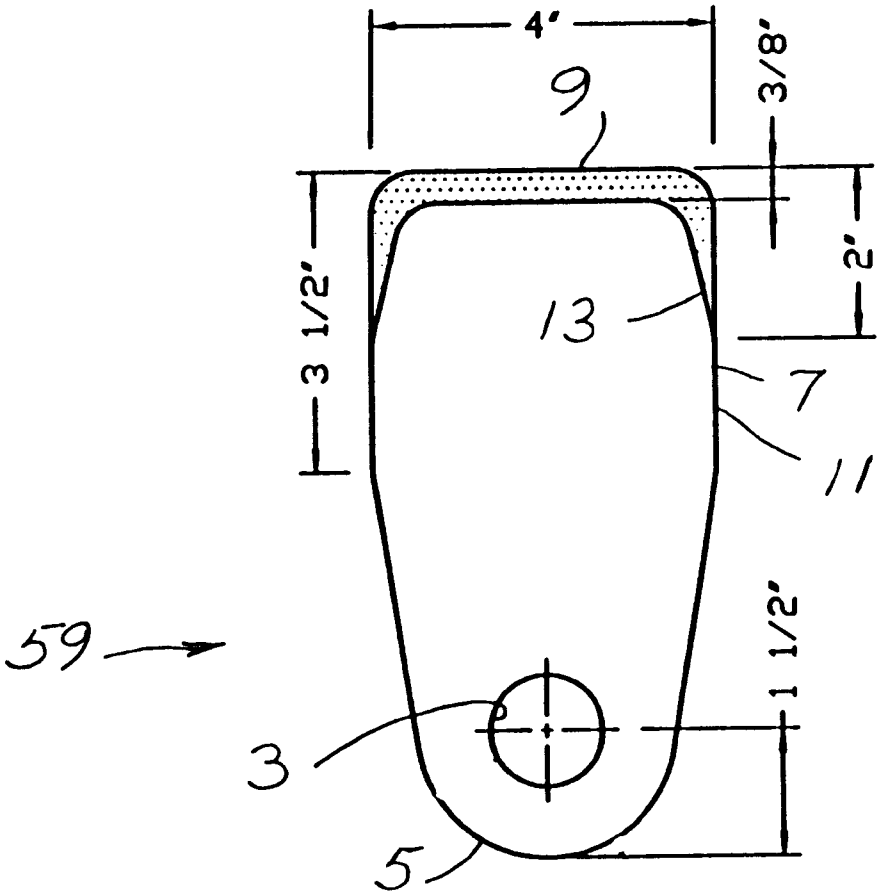

FIGS. 18 and 19 show a coal crusher 59 with a mounting hole 3 near its proximal end 5, and a ⅜" tungsten-carbide layer 7 at its distal end 9. The tungsten-carbide-embedded steel layer is extended at its sides 11, and it is tapered 13 so that the point of maximum thickness of the carbide-embedded layer corresponds with the corners of the coal crusher 59.

Figure 21:
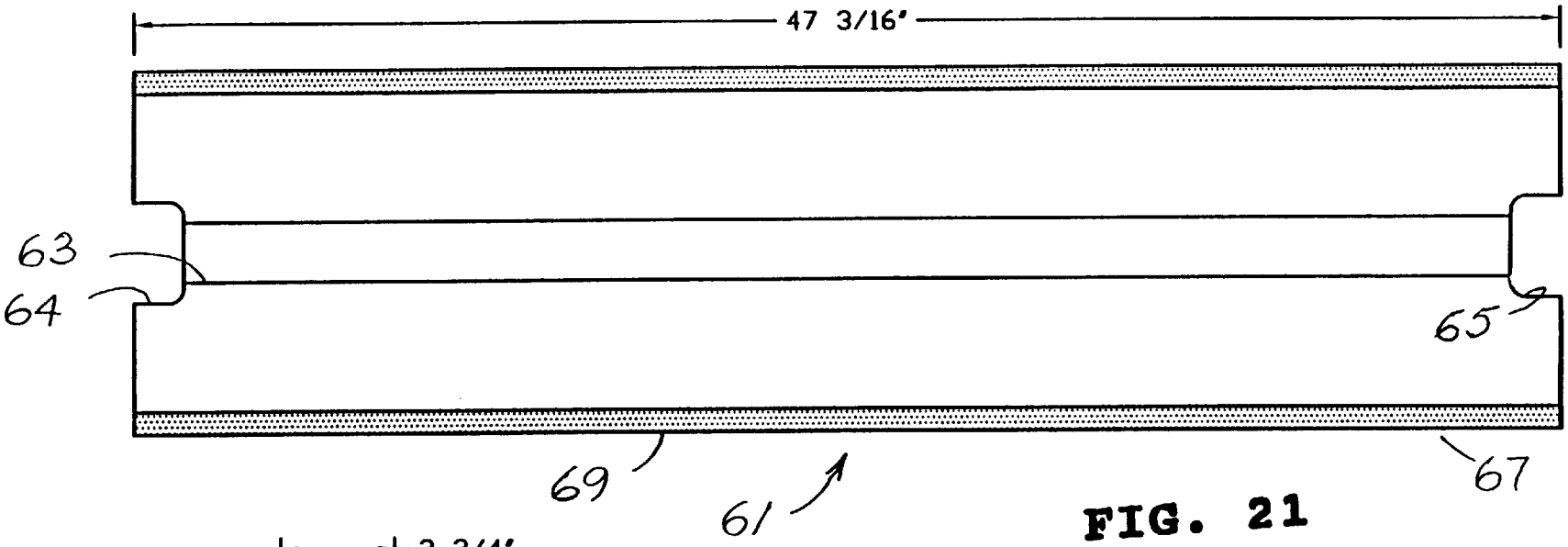
FIGS. 20 and 21 are side and top views of a blow bar.
Figure 20:
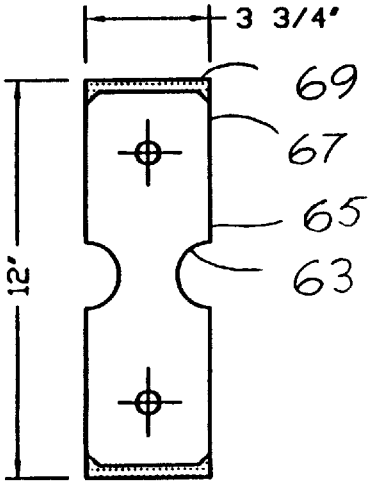

A carbide coated blow bar 61 is shown in FIGS. 20 and 21. The blow bar has parallel semicircular recesses 63 at its middle or proximal portion 65, and has two distal portions 67 with tungsten-carbide particle embedded layers 69.

Figure 23:
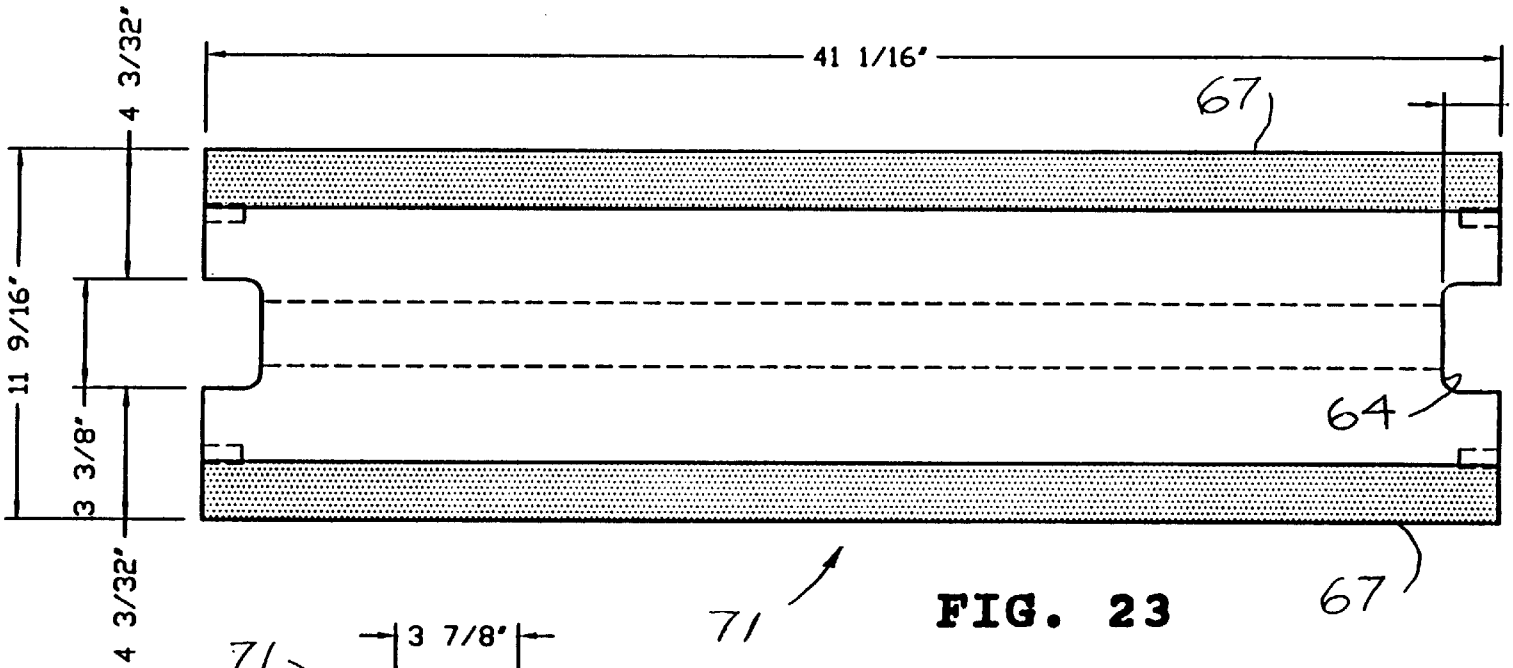
FIGS. 22 and 23 are side and top views of a blow bar.
Figure 22:
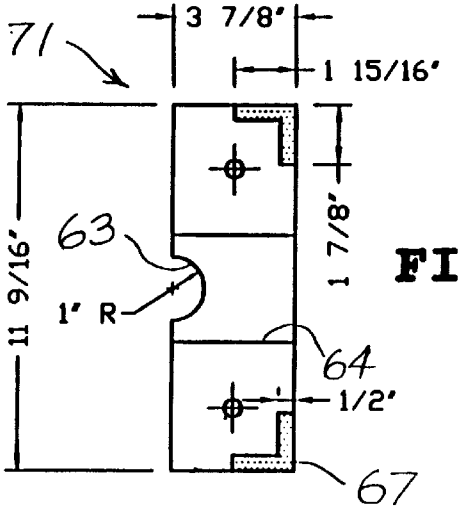

A blow bar 71 shown in FIGS. 22 and 23 has a central mounting recess 63 and end recesses 64 in a middle or proximal portion 65. Distal portions 67 have tungsten-carbide-embedded steel corners.

Figures 24, 25, 26:
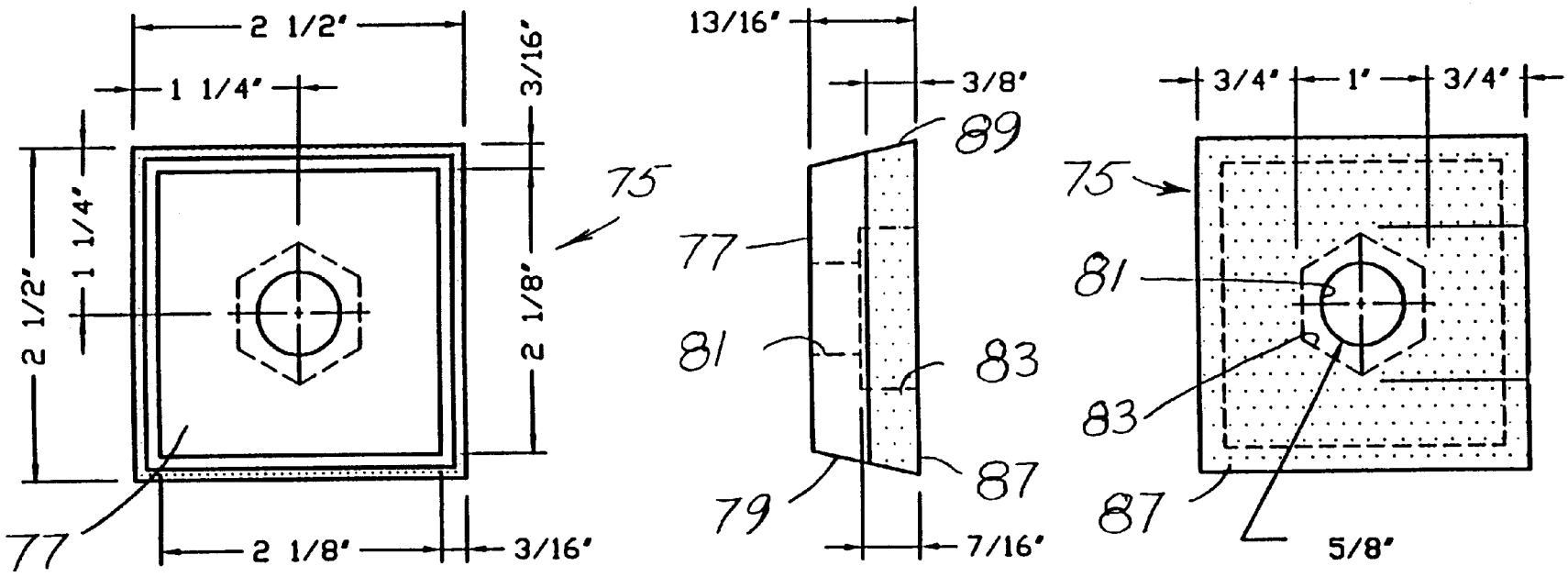
FIGS. 24, 25 and 26 are top, side and bottom views of a chipper tooth.

FIGS. 24, 25 and 26 show a chipper tooth 75. The chipper tooth has a flat proximal end 77 and sloping sides 79. A bolt-receiving opening 81 extends through the upper proximal portion, and a nut-receiving hexagonal opening 83 extends in extension of the opening 81. The flat distal portion 85 has a ⅜" thick layer 87 of tungsten-carbide-embedded steel. Parts of the sides 79 are coated 89 with the abrasive and wear resistant layer.

Figure 29:
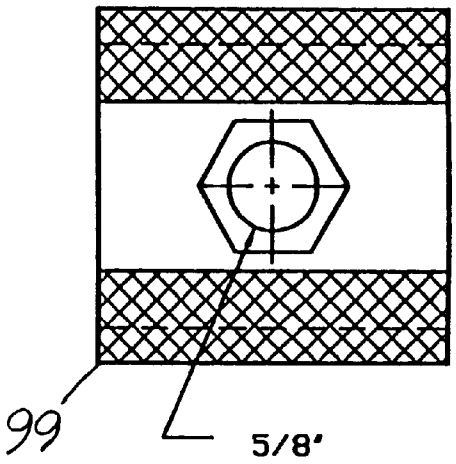
FIGS. 27, 28 and 29 are top, side and bottom views of an alternate chipper tooth.
Figure 28:
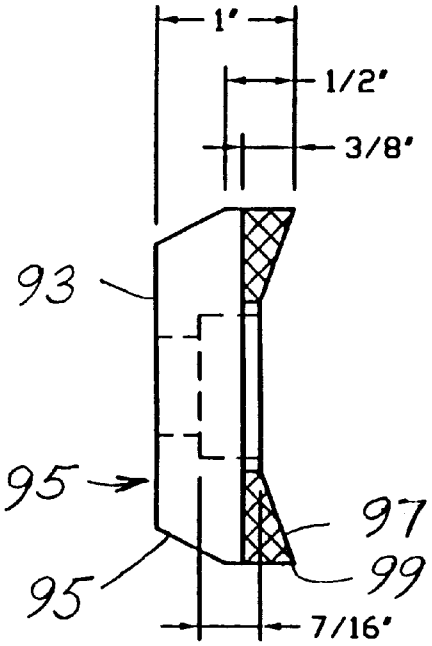
Figure 27:
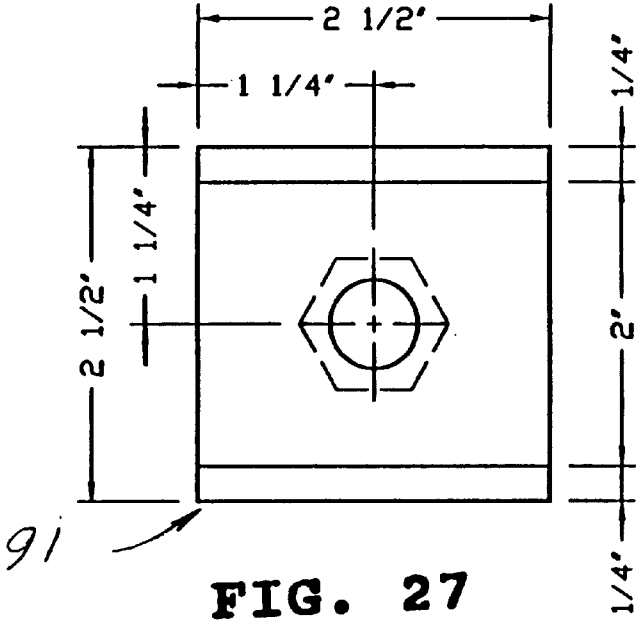

An alternate chipper tooth is shown in FIGS. 27, 28 and 29. Chipper tooth 91 has a flat upper proximal face 93 at the proximal end, and has two oppositely sloping sides 95. Two cutting lobes 97 are arranged on the distal end, which lead to straight distal edges 99.

Figure 32:
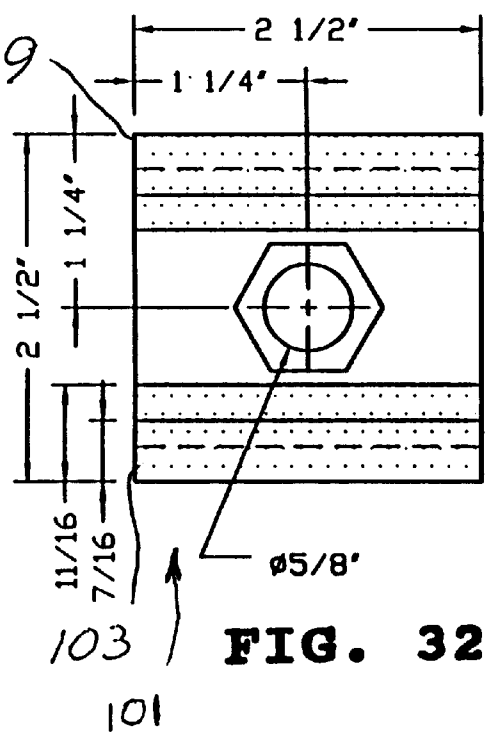
FIGS. 30, 31 and 32 are views of an alternate chipper tooth.
Figure 31:
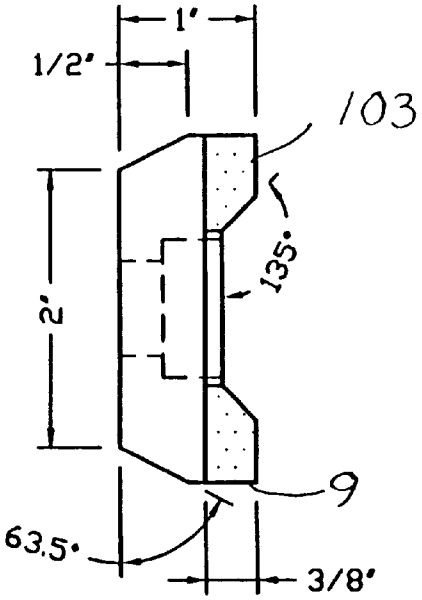
Figure 30:
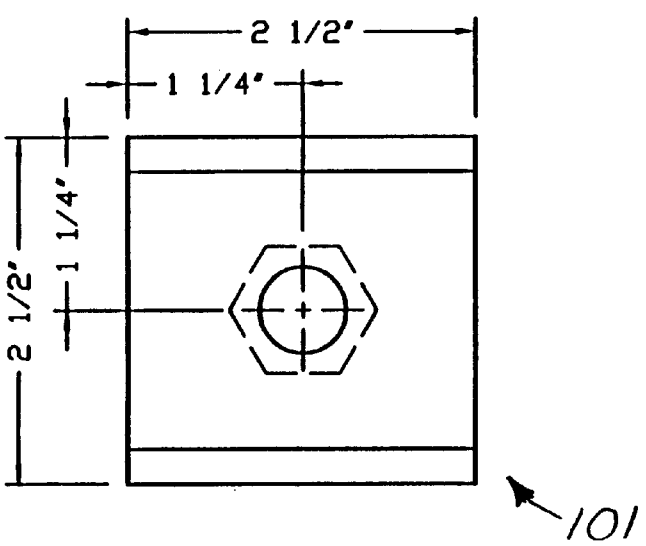

A slightly different chipper tooth 101 is shown in FIGS. 30–32. The distal faces 103 are flat. The integral carbide layer forms part of the side coatings of chipper teeth 75, 91 and 101.

Figure 34:
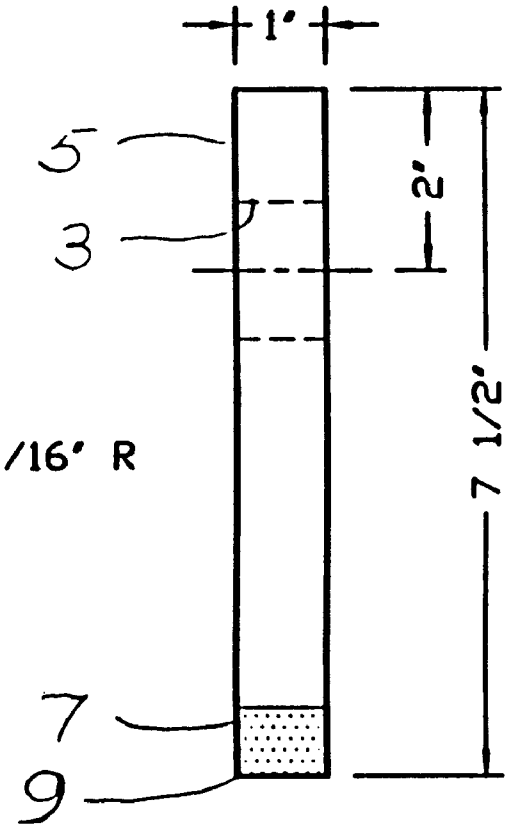
FIGS. 33 and 34 are side and end views of a tub grinder swing hammer constructed according to the invention.
Figure 33:
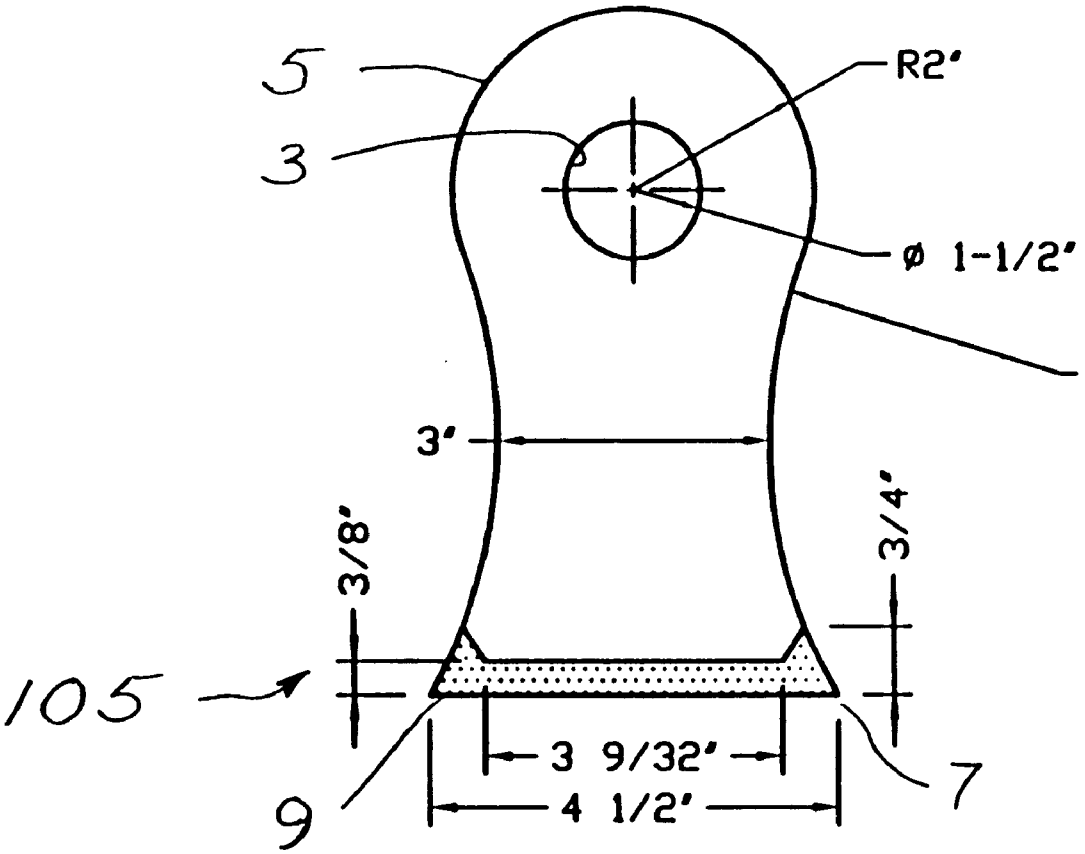

An alternate swing hammer 105 is shown in FIGS. 33 and 34. The swing hammer has a mounting opening 3 in proximal end 5, and a distal end 7 with a carbide particle embedded steel layer 9. Sides 107 are curved, and points 109 are formed at distal edges of the swing hammer.

Figure 36:
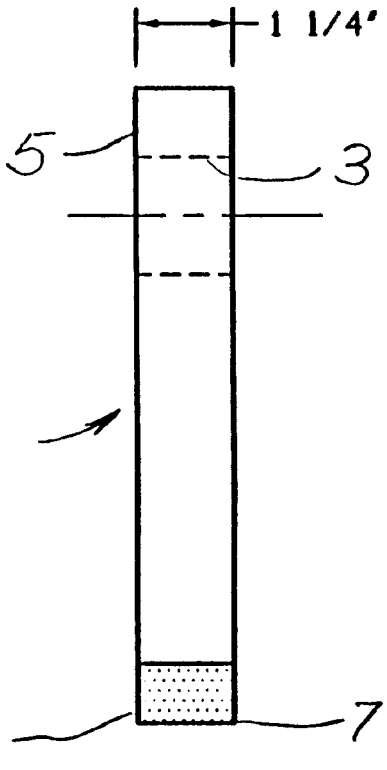
FIGS. 35 and 36 are side and top views of a chipper hammer.
Figure 35:
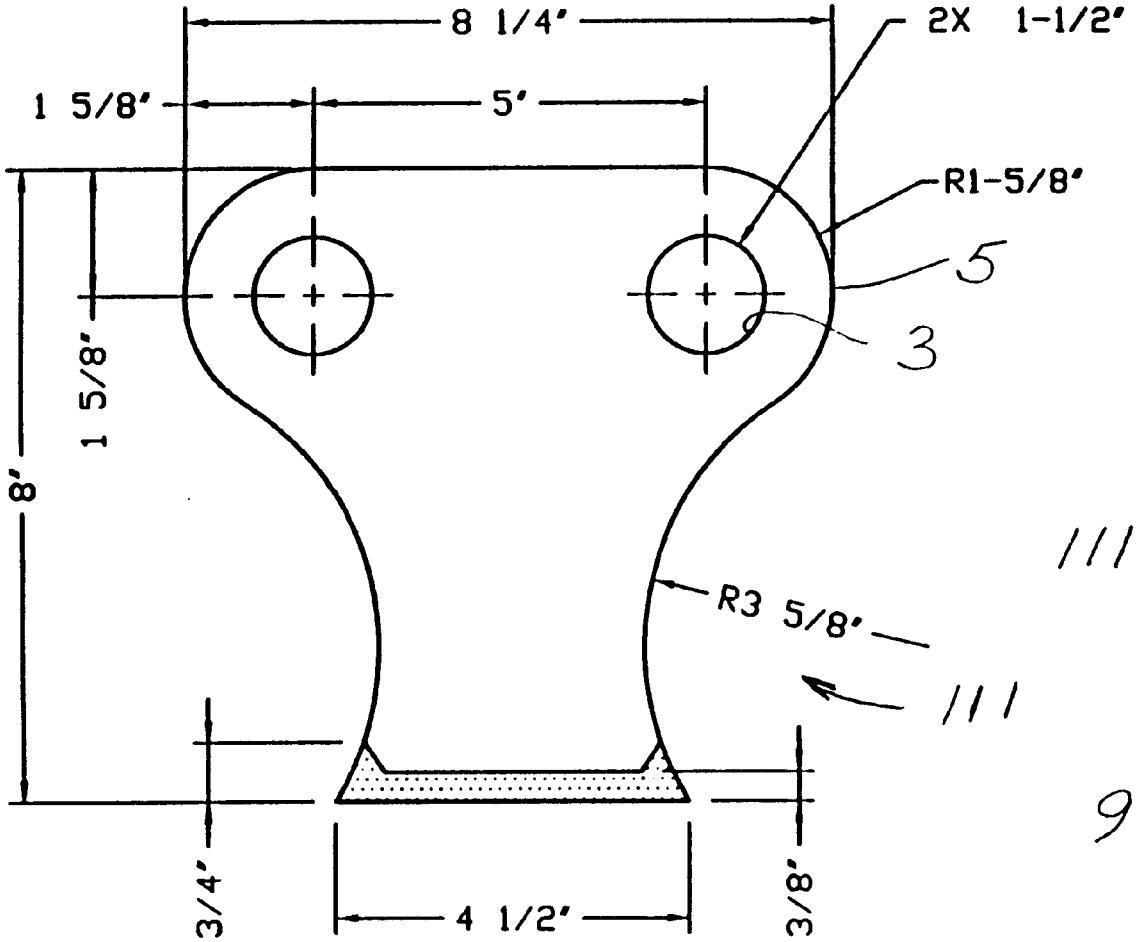

A similar swing hammer 111 shown in FIGS. 35 and 36 has two mounting holes 3 mounted at its proximal end.

Figure 37:
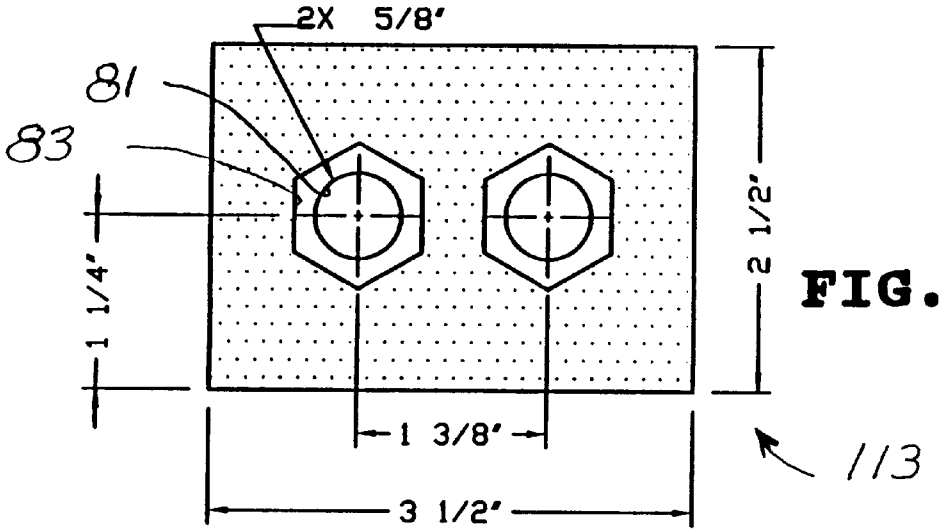
FIGS. 37, 38 and 39 are bottom, side and end views of a chipper.
Figure 38:
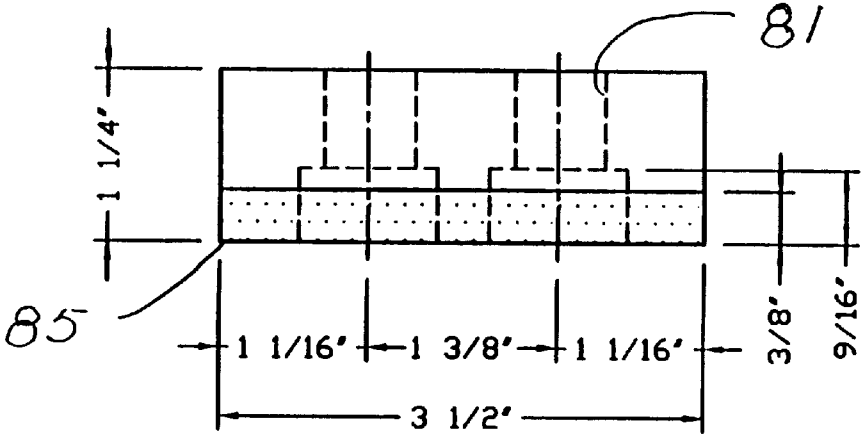
Figure 39:
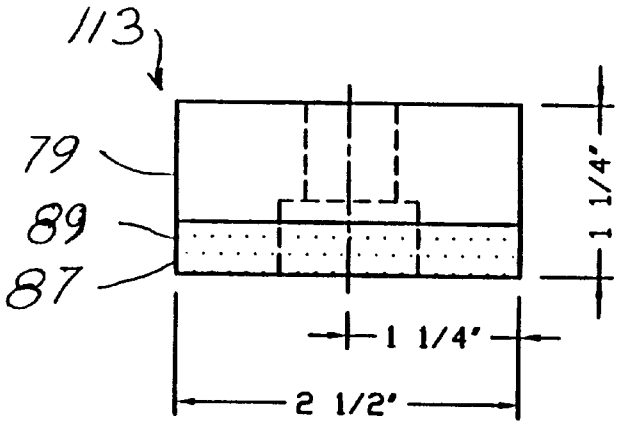

As shown in FIGS. 37, 38 and 39, any of the chippers, for example 113, may have two mounting holes 81 with nut-receiving openings 83.

Figure 41:
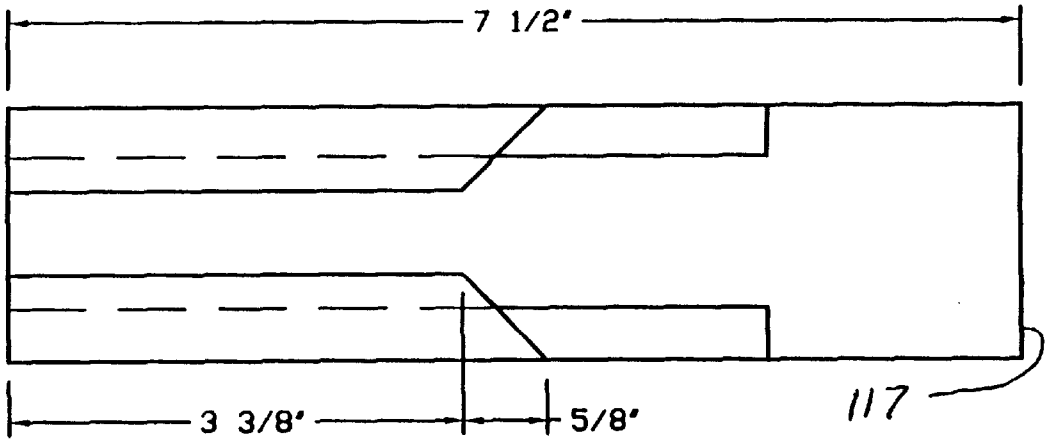
FIGS. 40, 41 and 42 are side, top, and end views of a ripper tooth.
Figure 40:
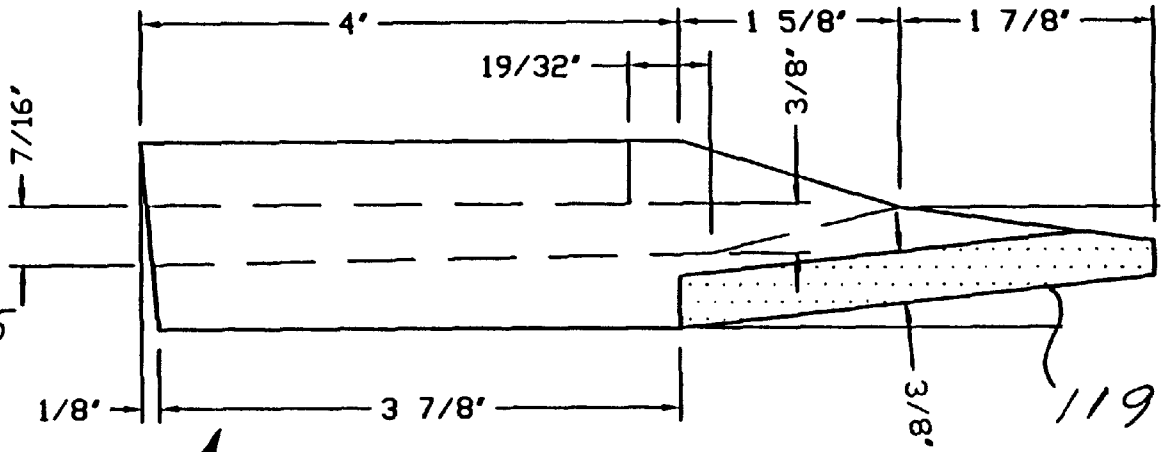
Figure 42:
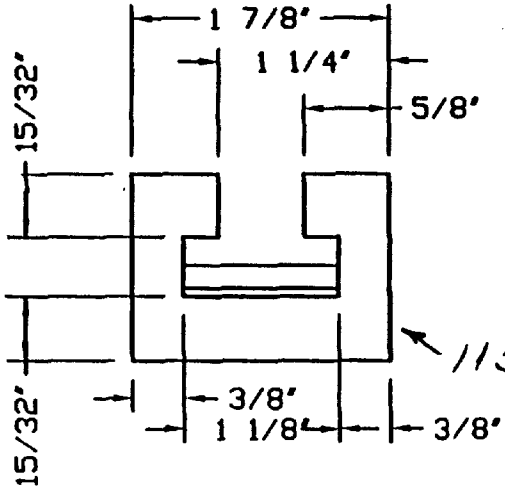
Figure 43:
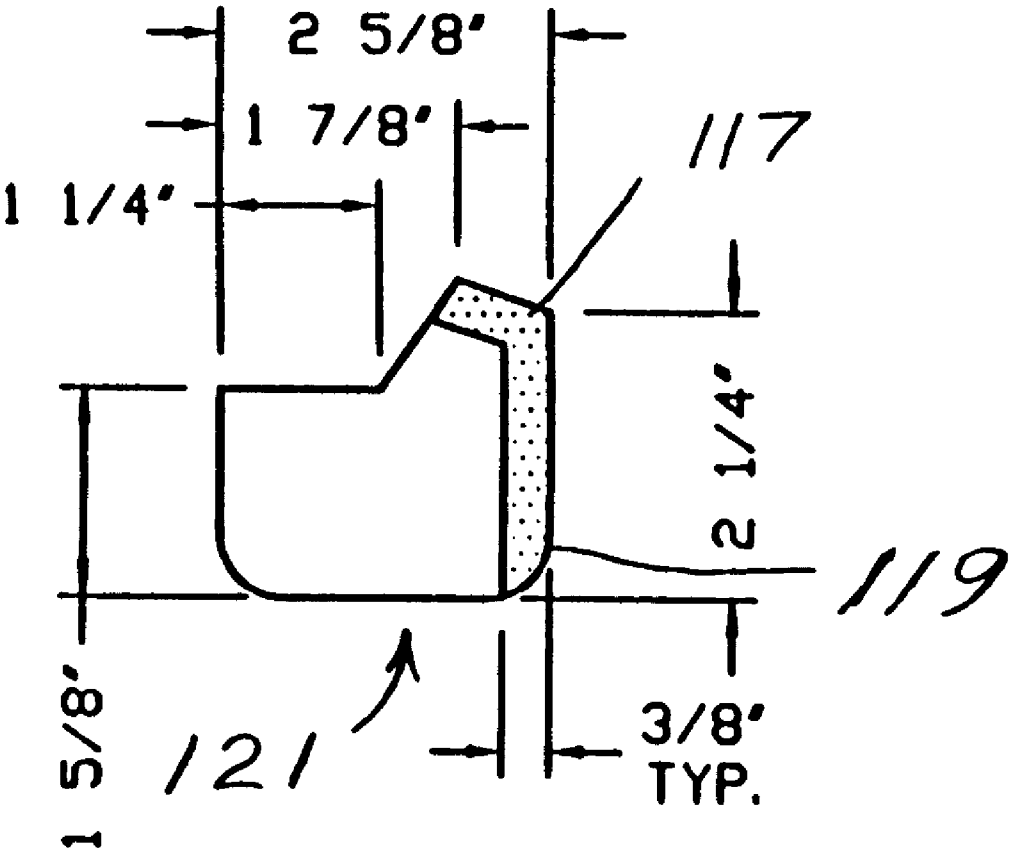
FIG. 43 is an end view of an impact bar.

The invention may be used on ripper teeth 115, as shown in FIGS. 40, 41 and 42. There the bottom and outer funnel or distal surface 117 has embedded tungsten-carbide particles in layers 119. The layer is about ⅜" thick. Wear resistant layers 119 are also formed on distal portions 117 of odd-shaped impacter bars 121, as shown in FIG. 43.

Figure 46:
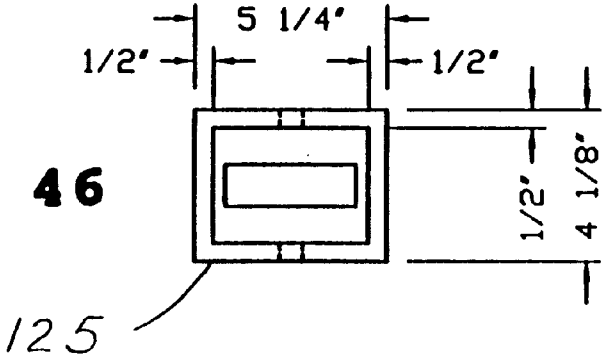
FIGS. 44, 45 and 46 are top, side and end views of a bucket tooth.
Figure 44:
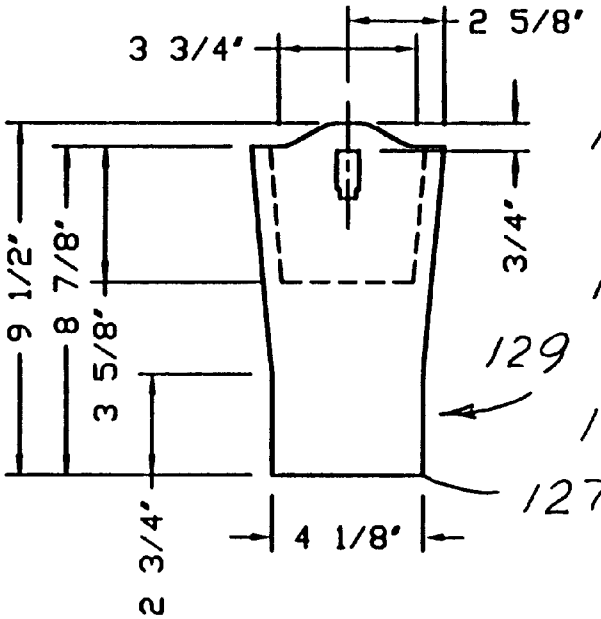
Figure 45:
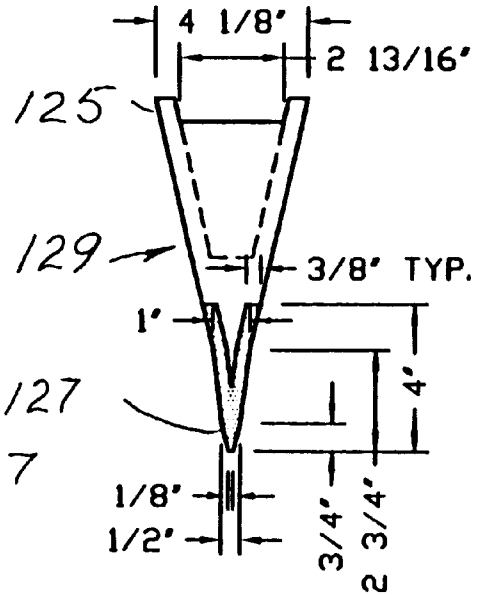

The invention is also used in a bucket tooth 123, such as shown in FIGS. 44, 45 and 46. FIG. 45 show a side elevation of the bucket tooth with a proximal mounting end 125 and a distal end 127, in which a tooth 129 is formed with a carbide-embedded layer about ⅜" thick and merging at the tip of the tooth.

Figure 48:
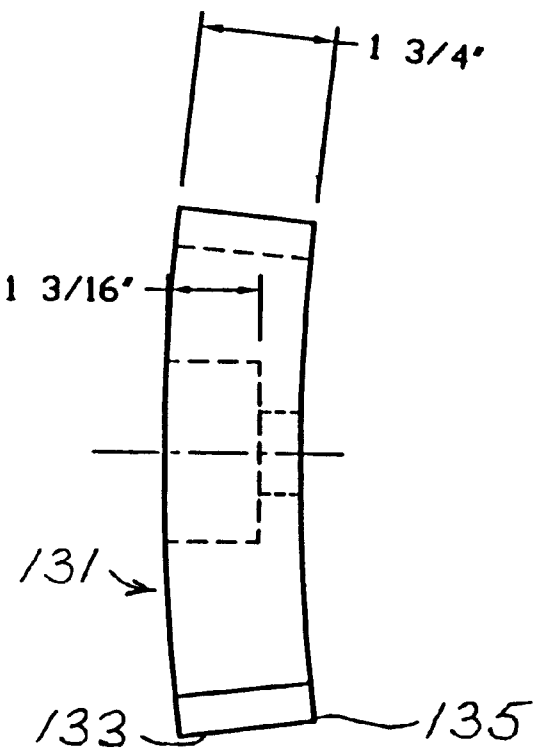
FIGS. 47 and 48 are side and end views of a roller cone center piece.
Figure 47:
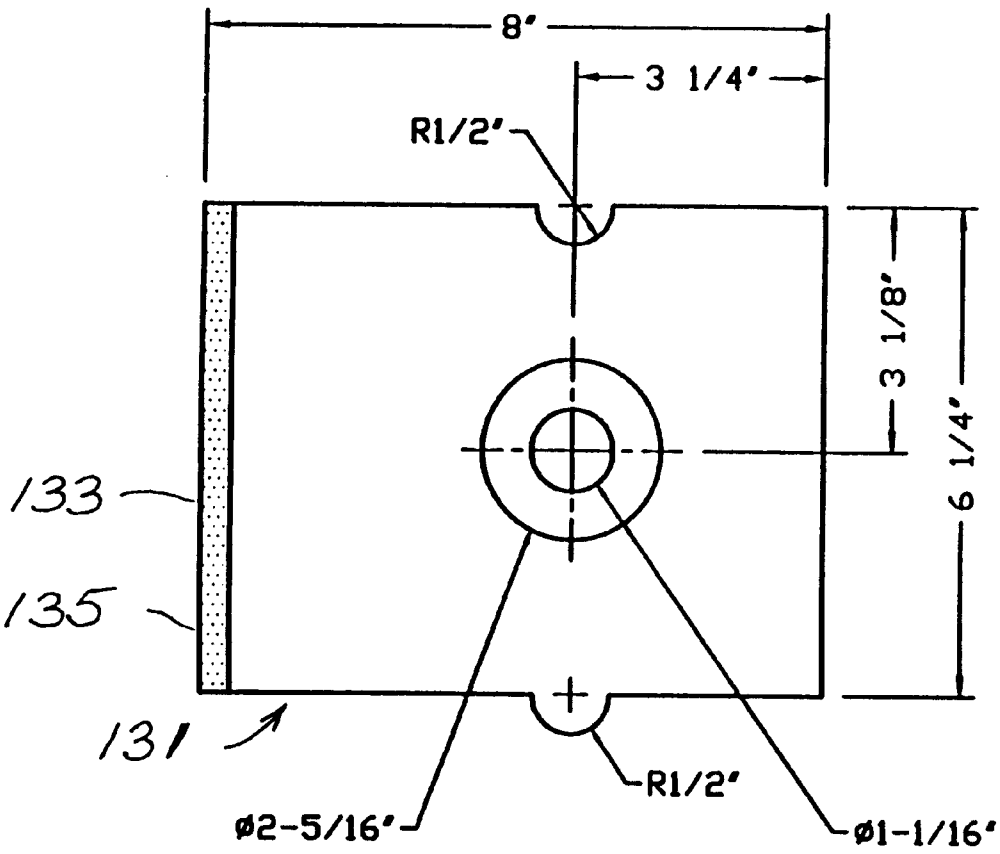

The invention is useful in roller cones centerpieces 131, such as shown in FIGS. 47 and 48, where a layer 133 of carbide-embedded steel is formed at the distal end 135.

Figure 50:
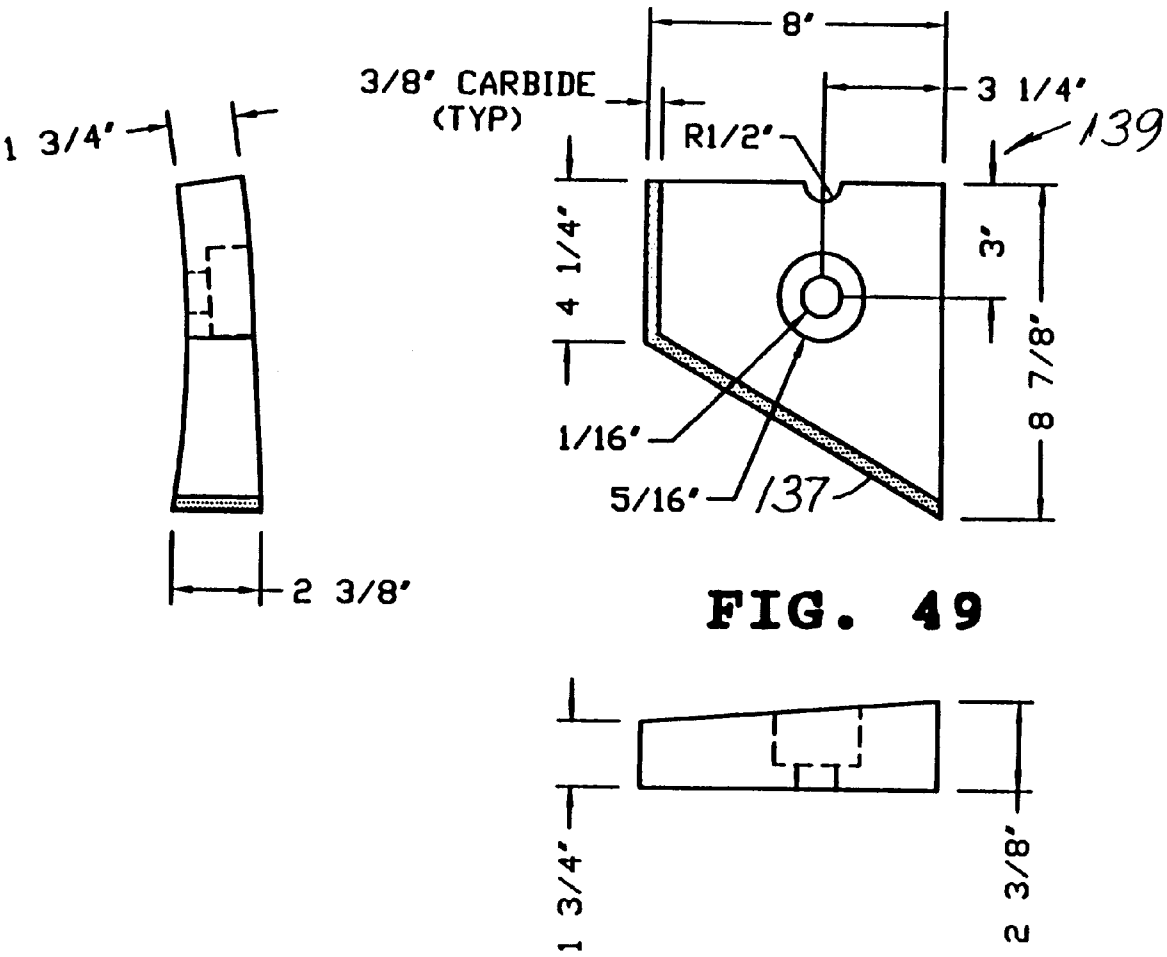
FIGS. 49 and 50 are top and end views of a roller cone end piece.
Figure 49:
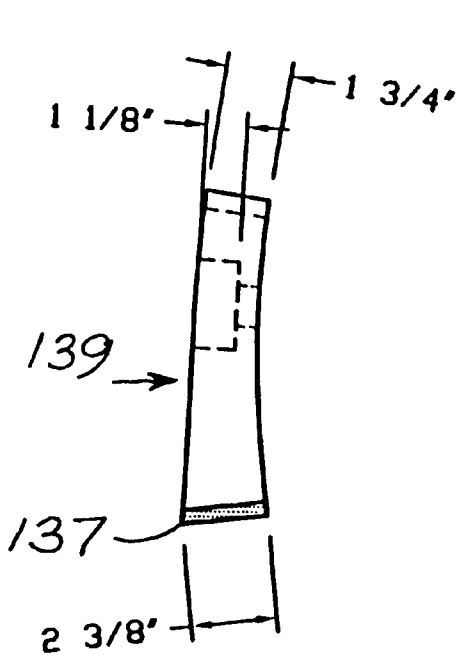

The invention is also used in the distal edges 137 of roller cone end pieces 139, as shown in FIGS. 49 and 50.

Figure 52:
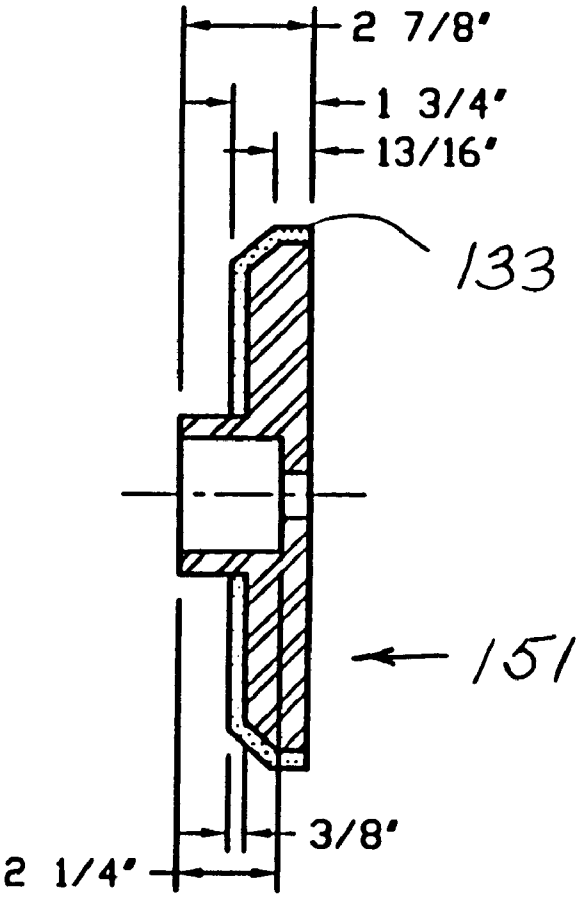
FIGS. 51 and 52 are top and side view of a wear disc.
Figure 51:
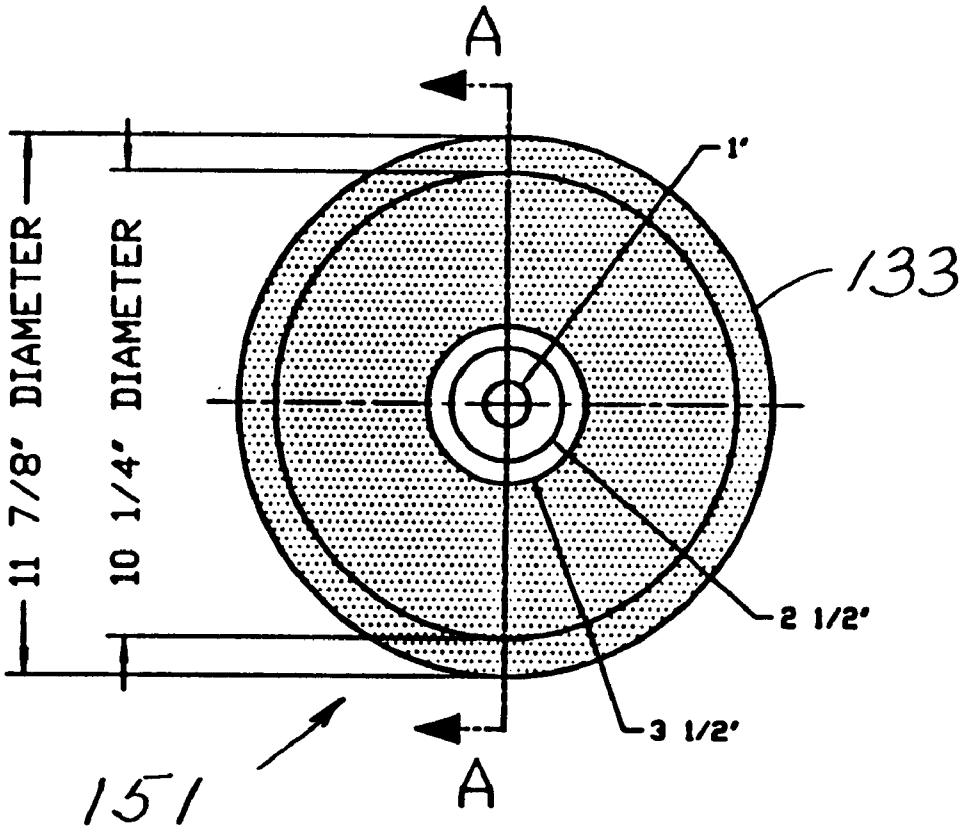

FIGS. 51 and 52 show a wear disc 151, which includes a carbide layer on the distal work-contacting surfaces.

The invention is useful in every area where replaceable parts have work-contacting or ground-contacting distal parts for breaking, comminuting or digging materials.

Preferably the layers of steel with embedded tungsten-carbide particles are about ⅜" thick. The products may be made by casting the product base with the proximal and medial portions, and then adding a pre-cast carbide-embedded steel distal end by welding or brazing. Alternatively a pre-cast carbide-embedded steel preform may be inserted in the mold at its desired position, and the steel body may be cast in the mold with the preform. Alternatively, the carbide particles may be placed in the mold in the desired positions with the steel falling between and into the particles to provide an integral wear part with a carbide particle-embedded wear surface. Alternatively, the mold surface may be lined with carbide particles in the desired areas, with the carbide particles migrating into the steel as it is poured in those areas before pouring the steel for the complete casting.

In one preferred form of the embodiment, the tungsten-carbide is molded under pressure and centering temperature to the shaped thin surface. That centered preform is then placed in the mold in which the steel wear member is cast.

While the invention has been described with reference to specific embodiments, modifications and variations of the invention may be constructed without departing from the scope of the invention, which is defined in the following claims.

I claim:

1. Wear resistant hammer and chipper wear parts comprising a cast mild steel body with proximal and distal ends, an attachment at the proximal end of the body, and a carbide filled steel layer forming a surface covering a distal end portion of the body, the surface layer being filled with carbide so that a carbide layer coats the distal end portion of the body.

2. Wear resistant hammer and chipper wear parts comprising a cast carbon steel body with proximal and distal ends, an attachment mount at the proximal end of the body, and a surface recess surrounding the distal end of the body, the surface recess having a carbide-embedded steel layer so that the carbide-embedded steel layer covers the distal end portion of the body.

3. The wear parts of claim 2, wherein the body is heat treated and hardened near the distal end.

4. The wear parts of claim 3, wherein the wear part body has milder steel in the proximal end.

5. The wear part of claim 2, wherein hardness increases from the proximal end to the distal end.

6. The wear parts of claim 2, wherein the layer is cast.

7. The wear parts of claim 2, wherein the carbide layer extends around lateral surfaces of the wear parts adjacent the distal end, and wherein the carbide layer coats the wear parts over the distal end so that sides of the body near the distal end are commensurate with sides of the body near the proximal end.

8. The wear parts of claim 7, wherein the carbide layer tapers outwardly from the distal end toward the proximal end, and wherein the coating layer is thinned near the proximal end.

9. The wear parts of claim 7, wherein ends of the carbide layer closest the proximate end are sloped.

10. The wear parts of claim 6, wherein the carbide layer is about ⅜" thick.

11. The wear parts of claim 2, wherein the carbide layer extends laterally outward from the carbide layers.

12. The wear parts of claim 2, wherein opposite lateral faces and opposite leading and trailing end faces and wherein the opposite side faces are devoid of carbide layers, and wherein the opposite leading and trailing edge faces have the carbide layers near the distal end.

13. The wear parts of claim 2, wherein the lateral distal faces have major carbide layers around which steel of increased carbon content is cast, and further comprising outer surfaces in the increased carbon steel layer near the distal end, wherein the carbide layer covers the outer surfaces in the second molded steel layer.

14. The wear parts of claim 2, wherein the distal ends have laterally extended shapes with respect to the proximal ends.

15. The wear parts of claim 2, wherein the proximal ends have laterally extended shapes with respect to the distal ends.

16. The hammer and chipper wear parts of claim 2, prepared by casting the wear parts with mounting configurations at proximal ends and molding carbide layers at distal ends, and filling the carbide layers with carbide material.

17. The wear parts of claim 16, wherein the method comprises molding mild steel, forming a first carbide layer at a distal end of the mild steel, molding a carbon steel in the carbide layer at the distal end of the mild steel, and molding a relatively thin carbide layer in a distal end of the carbon steel and filling the thin carbide layer with a carbide material.

18. The wear parts of claim 16, further comprises increasing hardness of the steel from the proximal to the distal end.

* * * * *